US009120316B2

(12) United States Patent
Williamson et al.

(10) Patent No.: US 9,120,316 B2
(45) Date of Patent: Sep. 1, 2015

(54) VARIABLE FORCE WIPER FOR MAINTENANCE STATION OF IMAGING DEVICE

(75) Inventors: Randal S Williamson, Georgetown, KY (US); Gregory Leon Hutchison, Shelbyville, KY (US); Jonathan Andrew Wharton, Lexington, KY (US); Brian Michael Langness, Shelbyville, KY (US); Lane Thomas Butler, Lexington, KY (US)

(73) Assignee: Funai Electric Co., Ltd. (JP)

( * ) Notice: Subject to any disclaimer, the term of this patent is extended or adjusted under 35 U.S.C. 154(b) by 225 days.

(21) Appl. No.: 13/408,506

(22) Filed: Feb. 29, 2012

(65) Prior Publication Data

US 2013/0222474 A1 Aug. 29, 2013

(51) Int. Cl.
*B41J 2/165* (2006.01)

(52) U.S. Cl.
CPC ..... *B41J 2/16538* (2013.01)

(58) Field of Classification Search
CPC ..... B41J 2/16552; B41J 2/16535
USPC ..... 347/33; 101/364, 365
See application file for complete search history.

(56) References Cited

U.S. PATENT DOCUMENTS 5,151,715 A * 9/1992 Ward et al. ..... 347/33
5,612,722 A * 3/1997 Francis et al. ..... 347/33
5,640,182 A * 6/1997 Bahrami et al. ..... 347/33
6,017,110 A * 1/2000 Jackson ..... 347/33
6,193,357 B1 * 2/2001 Medin ..... 347/33
6,290,324 B1 * 9/2001 Jackson et al. ..... 347/33
6,540,324 B2 * 4/2003 Medin ..... 347/33
7,077,498 B2 * 7/2006 Nagase ..... 347/33
7,771,002 B2 * 8/2010 Mackey et al. ..... 347/22
7,891,763 B2 * 2/2011 Hibbard et al. ..... 347/33
2001/0000434 A1 * 4/2001 Medin ..... 347/33
2002/0015070 A1 * 2/2002 Taylor et al. ..... 347/32
2004/0130589 A1 * 7/2004 Nagase ..... 347/33

* cited by examiner

*Primary Examiner* — Matthew Luu
*Assistant Examiner* — Patrick King
(74) *Attorney, Agent, or Firm* — Amster, Rothstein Ebenstein LLP

(57) ABSTRACT

A wiper for a maintenance station of an imaging device includes a foundational body and a flexible blade. The body rigidly attaches to the maintenance station. The blade attaches to the body. The blade scrapes fluid and debris from a printhead during use. The blade comprises a flexible material having terminal sections intervened by a central section. Each terminal section connects to the body with a thicker expanse of flexible material, whereas the central section connects to the body with a thinner expanse. The connection provides the terminal sections with a higher wiping force and a shorter effective beam length for wiping an encapsulant of the printhead and gives while the central section a lower wiping force and a longer effective beam length for wiping a nozzle plate of the printhead. The embodiments note curved surfaces with variable radiuses where the expanses of flexible material connect to the body.

6 Claims, 10 Drawing Sheets

VARIABLE FORCE WIPER FOR MAINTENANCE STATION OF IMAGING DEVICE

FIELD OF THE INVENTION

The present invention relates to maintenance stations of imaging devices, such as inkjet printers. More particularly, the invention relates to wipers of maintenance stations. Wipers having variable force can more or less forcibly clean printhead structures having more or less wiper durability, such as encapsulation or nozzle plates.

BACKGROUND

The art of imaging with micro-fluid technology is relatively well known. A (semi) permanent or replaceable ejection head has access to local or remote fluid. The fluid ejects from the head to a media in a pattern of pixels corresponding to images being printed. Over time, fluid and debris builds up on surfaces of the ejection head, which requires wiping. Variations in the terrain of wiped surfaces cause wipers to occasionally lose contact with the ejection head. Fluid pools in regions of the head and detrimentally accumulates in volume. As motion occurs with a carrier scanning the ejection head back and forth past the media, the fluid migrates and accumulates elsewhere on the head.

A need exists in the art for improving maintenance stations. The need extends to improving wipers and their operation, including reaching pools of aggregated fluid and preventing migration. Additional benefits and alternatives are also sought when devising solutions.

SUMMARY

The above-mentioned and other problems become solved with variable force wipers for maintenance stations of imaging devices. A wiper includes a foundational body and flexible blade. The body attaches to the maintenance station, while the blade attaches to the body. The blade scrapes fluid and debris from a printhead during use. The blade comprises a flexible material having opposed terminal sections intervened by a central section. Each terminal section connects to the body with a thicker expanse of flexible material, whereas the central section connects to the body with a thinner expanse of flexible material. The connection gives the terminal sections a higher wiping force and shorter effective beam length and gives the central section a lower wiping force and longer effective beam length. The terminal sections wipe encapsulation of the printhead with higher force, while the central section wipes the nozzle plate with lower force. No longer is it required to have common forces wiping disparate structures of the printhead having disassociated sensitivities to wiping. As the encapsulant is generally taller than the nozzle plate, no longer is it required to lose contact between the wiper and surfaces having dissimilar geographies. To prevent leaving behind a wake of wiped fluid, wipers further note a continuous wiping edge along an entirety of the blade's longitudinal extent at the leading edge of the wiper in a direction of wipe.

In various embodiments of the invention, features note curved surfaces on a same side of the blade where the thinner and thicker expanses of material connect to the foundational body of the wiper. The curvatures of radius at the terminal sections of the wiper are larger than the curvature of radius at the central section. The radiuses provide a stronger, less flexible wiper at the terminal sections of the blade while, at the same time, provide a flimsier, less rigid wiper at its central section. The terminal sections are then free to stridently wipe durable printhead surfaces, such as encapsulation, while the central section simultaneously wipes less durable surfaces, such as the nozzle plate.

In a preferred embodiment, the curvatures of radius for each of the terminal sections are equal to one another and are about 2 mm. The curvature of radius for the central section is smaller and about 0.5 mm. As the wiper flexes near a top of the thicker and thinner expanses of material, a wiping moment occurs at the base of what is defined as the effective beam length of the terminal and central sections of the wiper. By keeping the curvatures of radius in check between the terminal sections and the central section, a ratio of wiping strength of 4 can be defined by dividing the large curvature of radius (2 mm) by the lower curvature of radius (0.5 mm). The ratio can be manipulated within a range, such as between ratios of 2-6, or other.

The wiper itself is made of a homogenous material of flexible material. Its genus is thermoplastic elastomers. A representative embodiment teaches "pellethane," sold by Lubrizol, Inc.

In other embodiments, the body of the wiper serves as a rigid foundation for flexing the blade of the wiper. The body has an open slot and slidingly receives a rigid member from the maintenance station. The slot is a rectangular-solid opening or an opening with raised wings in the terminal sections of the blade and both match the shape/size of the rigid member of the maintenance to provide a solid foundation to create the flexing moment for the blade.

These and other embodiments are set forth in the description below. Their advantages and features will become readily apparent to skilled artisans. The claims set forth various limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. The following detailed description, therefore, is not to be taken in a limiting sense and the scope of the invention is defined only by the appended claims and their equivalents. In accordance with the features of the invention, a maintenance station includes a wiper having variable force to wipe structures of a printhead having disparate wiping sensitivities.

Figure 1A:
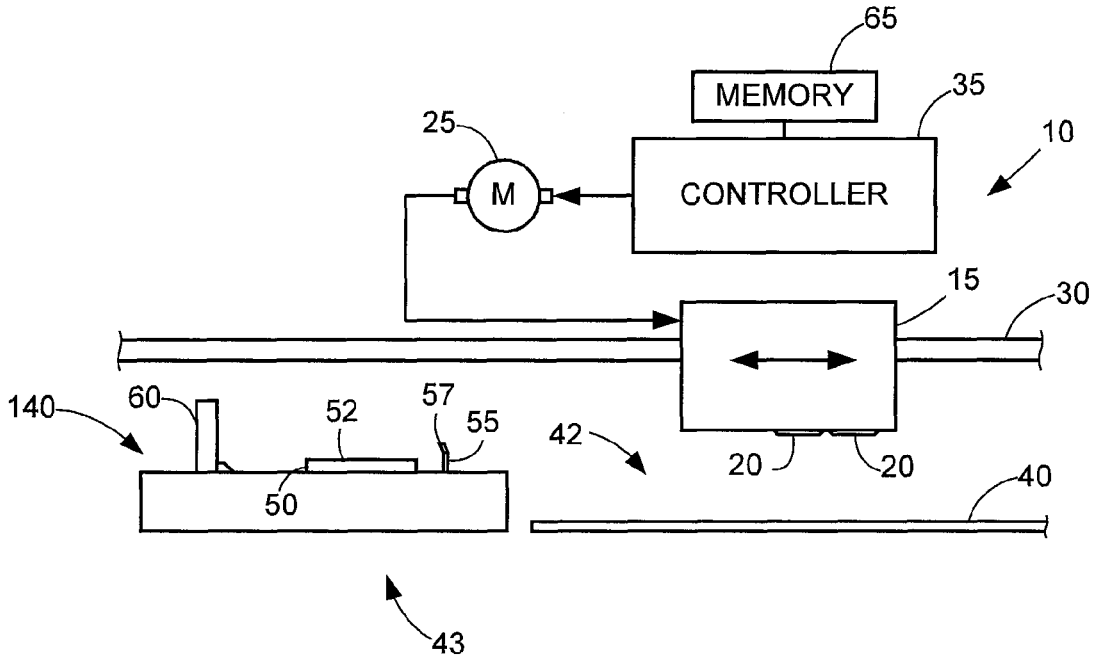
FIGS. 1A and 1B are diagrammatic views in accordance with the present invention showing maintenance stations for wiping printheads of imaging devices.
Figure 1B:
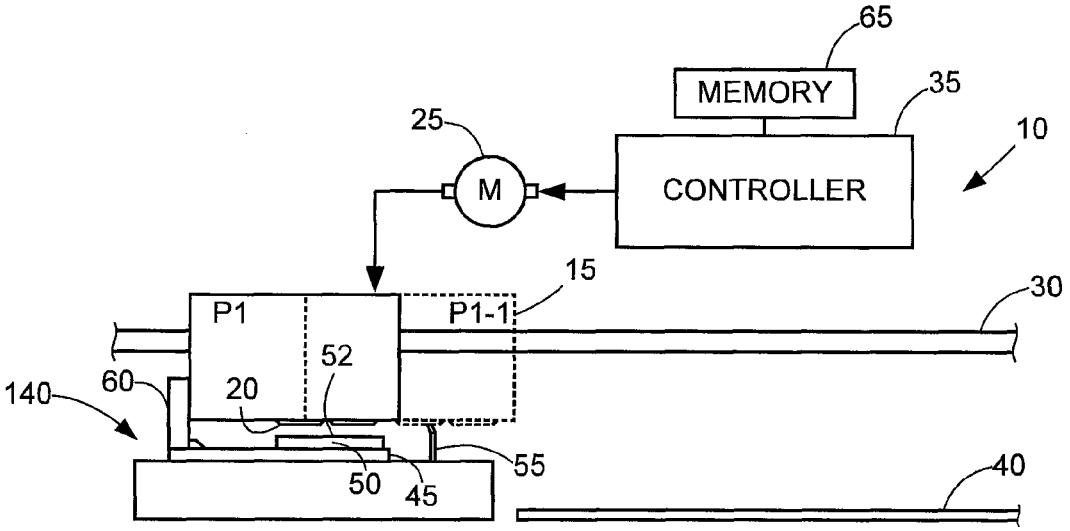

With reference to FIGS. 1A-1B, an imaging device 10 includes a carrier 15 mounting one or more disposable or (semi) permanent printheads 20. The printheads 20 have access to a local or a remote supply of fluid (ink) for imaging. A motor 25 drives the carrier back and forth along a shaft 30 at the directive of a controller 35 (having access to memory 65). The action defines both an imaging region 42 relative to a sheet of print media 40 and a non-imaging region 43 to conduct printhead servicing or maintenance operations. By comparing FIGS. 1A and 1B, artisans can observe the different regions and note printheads engaged in both imaging media (FIG. 1A) and servicing operations (FIG. 1B).

In the non-imaging region 43, a maintenance station 140 provides both nozzle capping (noted at position P1 (solid lines), FIG. 1B) and wiping (noted at position P1-1 (dashed lines), FIG. 1B). The station notes both a cap 50 and wiper 55. During capping, an upper portion 52 of the cap is raised upward by a platform 45 to contact and seat against an underside of the printheads or carrier to seal the nozzles during times of non-use. During wiping, a flexible blade 55 of the wiper is deflected past the nozzle plate of the printhead to scrape fluid and debris. A carrier engagement device 60 is provided to properly locate the carrier in the maintenance station and time the operations for capping and wiping.

Figure 2A:
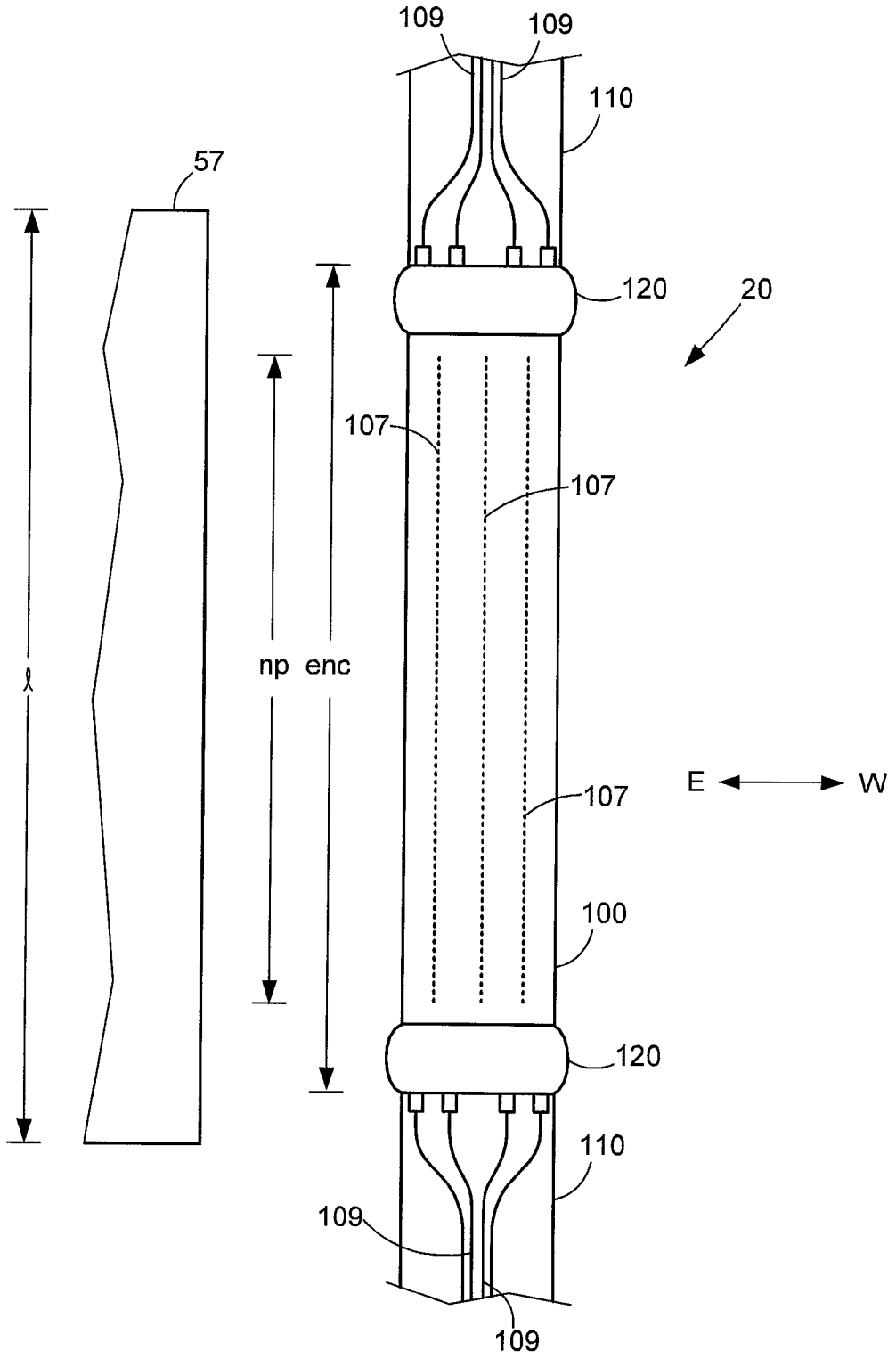
FIGS. 2A and 2B are views of to-be-wiped printheads, including nozzle plates, encapsulant and flexible circuits.
Figure 2B:
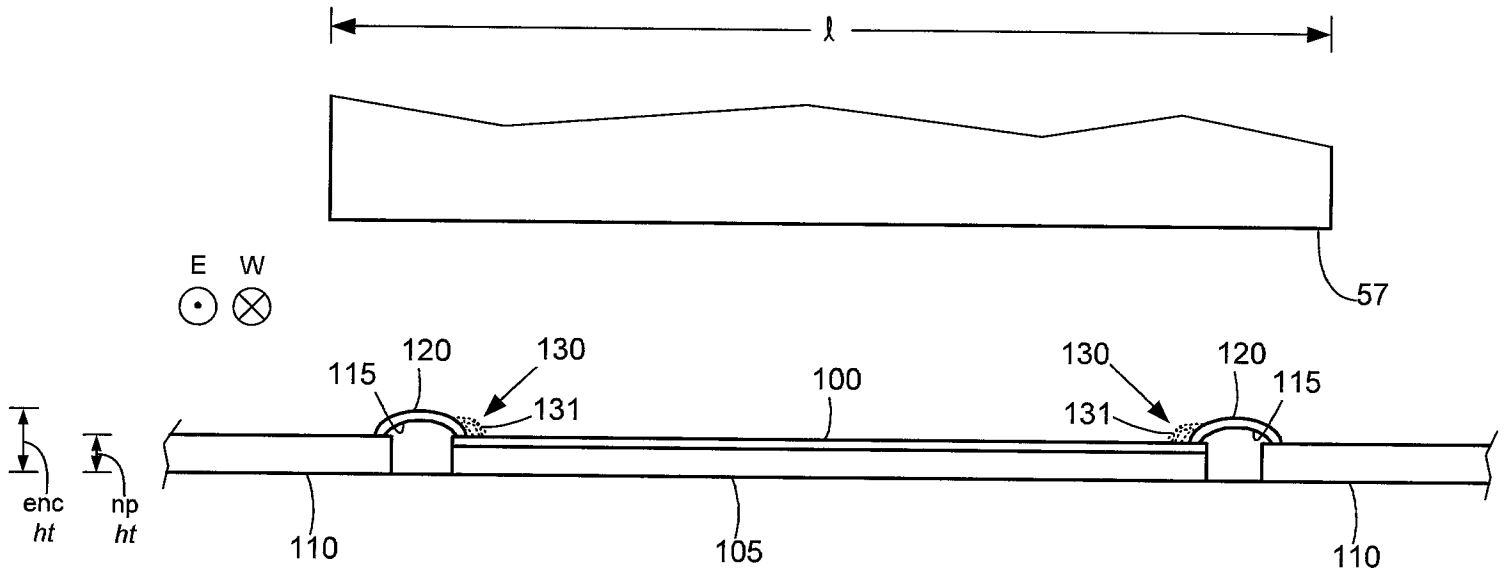

With reference to FIGS. 2A and 2B, a printhead 20 to-be-wiped includes a nozzle plate 100 on an ejection chip 105 to eject fluid through nozzles 107. Electrical signals are routed to the chip from the controller on signal lines 109 of a flexible TAB circuit 110. The signal lines electrically attach to the chip on either ends by way of interconnecting wires 115. An encapsulant 120 overcoats the wires to protect them and extends onto both surfaces of the nozzle plate and the flexible circuit.

During use, the blade 57 of the wiper moves back and forth past the printhead 20 in the east (E)-west (W) directions noted. It scrapes fluid and debris. As the longitudinal extent (l) of the blade extends beyond both the lengths of the nozzle plate (np) and nozzle plate plus encapsulation (enc), the wiper encounters diverse geographic heights between surfaces of the encapsulation (enc ht) and nozzle plate (np ht). In some instances, the height of the encapsulation is as much as 350 microns or more higher than the height of the nozzle plate. With rigid, inflexible wipers (prior art, not shown), blades tend to lose contact with to-be-wiped surfaces in hard to reach locations, such as nooks and crannies 130, and fluid and debris 131 is allowed to detrimentally accumulate.

To counter this, the wiper of the present invention is made of variable force. The variability allows conforming the blade to reach the nooks and crannies 130 and to imparting differing wiping forces to structures of the printhead having disparate wiping sensitivities. A stronger portion of the wiper is made to impart a high wiping force to regions of the encapsulation 120, having low sensitivity to wiping, while a flimsier portion of the wiper is made to impart a low wiping force to the region of the nozzle plate 100, being more sensitive to wiping.

Figure 3:
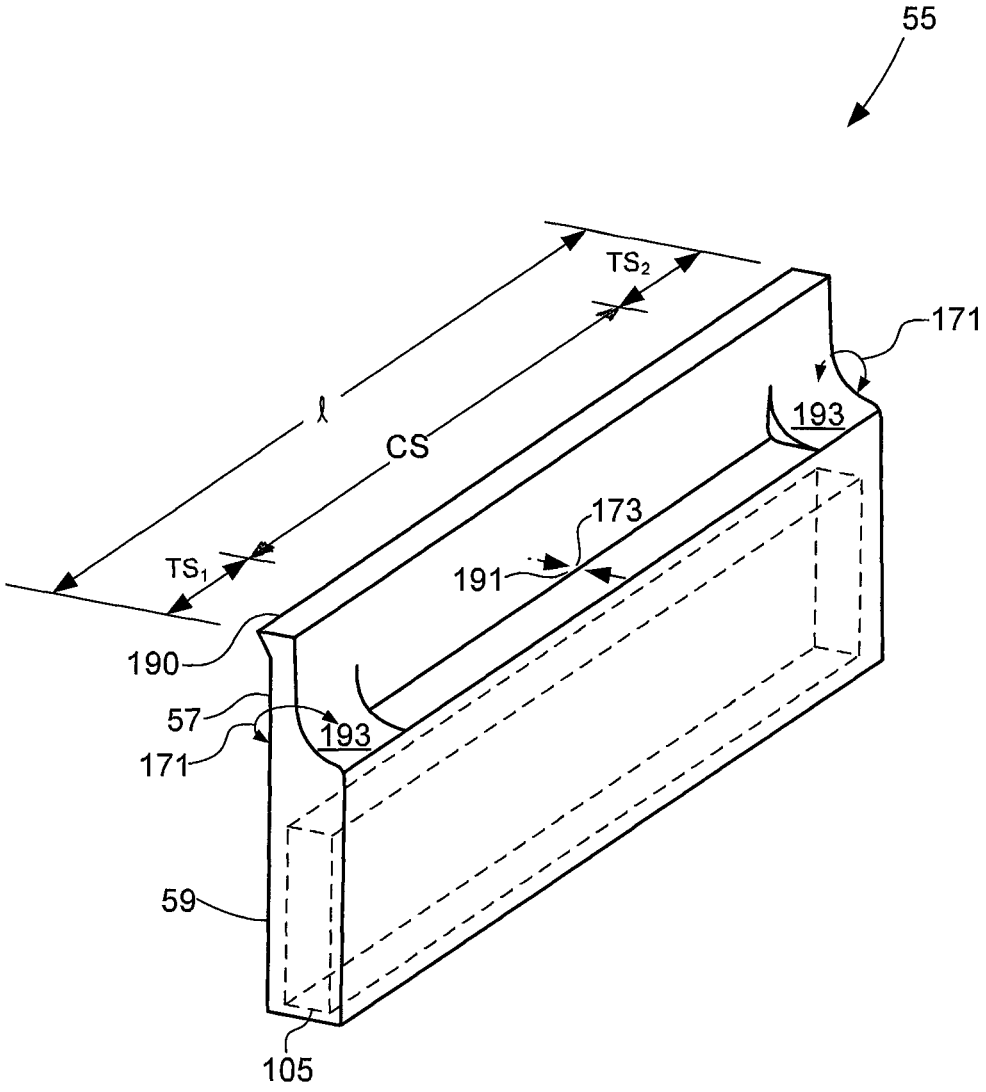
FIG. 3 is a diagrammatic view of a representative wiper.

With reference to FIG. 3, a first embodiment of the wiper 55 includes a foundational body 59 and a flexible blade 57. The foundational body attaches to the maintenance station (FIGS. 1A, 1B). The blade connects to the body.

Figure 6:
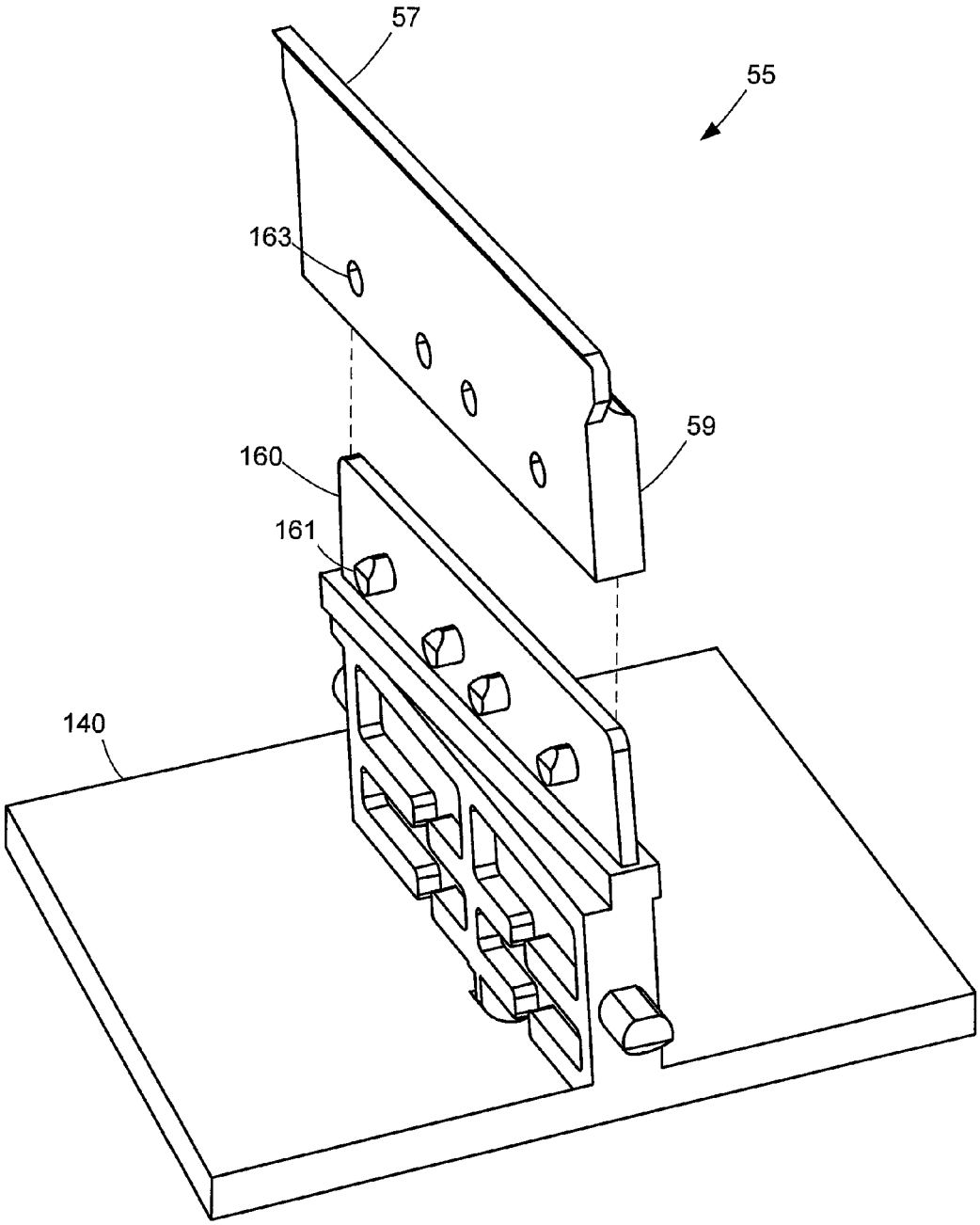
FIG. 6 is a wiper attaching to a holder of a maintenance station.

With further reference to FIG. 6, the body 59 has an open slot 150 for receipt of a rigid member 160 from the maintenance station 140. The slot is a rectangular opening similar in size and shape to the rigid member it receives and the wiper attaches by sliding the slot onto the rigid member. In this way, wipers can be readily attached to maintenance stations 140 during initial manufacturing and replaceably attached over the lifetime of the imaging device. When inserted, the rigid member 160 and the body 59 keep stiff the base of the wiper which allows the blade 57 to flex or rotate about the base to bend for wiping. Fixed protuberances 161 of the rigid member may mate with openings 163 of the wiper to keep in place the wiper on the rigid member and to define a known operational height of the blade during use. Of course, other attachment schemes may be used.

Figure 4B:
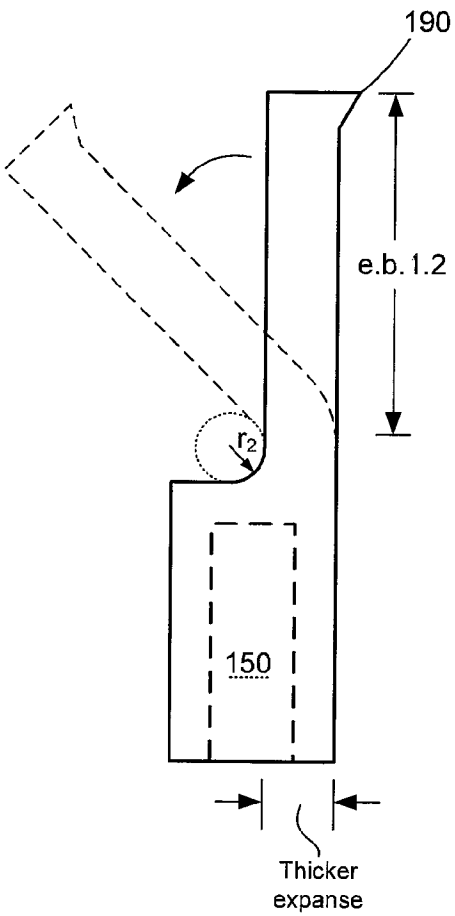
FIGS. 4A and 4B are sectional views of the wiper of FIG. 3 in their upright and deflected wiping positions.
Figure 4A:
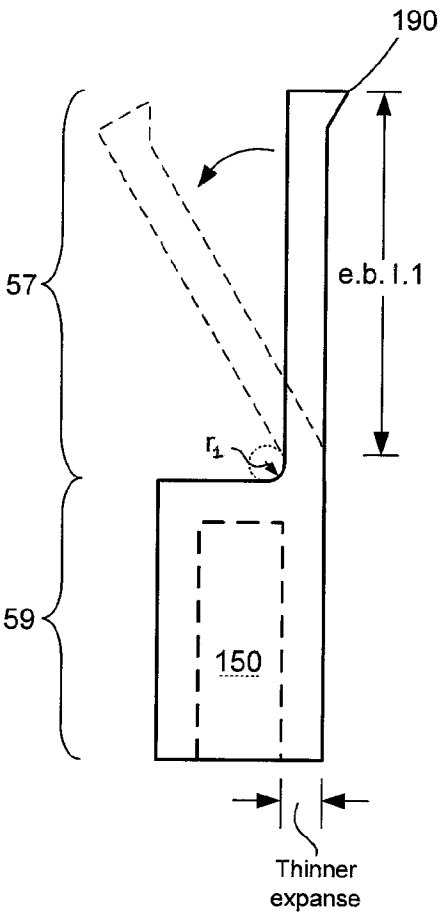

With continued reference to FIG. 3, and further reference to FIGS. 4A and 4B, the blade 57 of the wiper has a longitudinal extent (l). Along at least one side, it has a continuous wiping edge 190. The edge is provided to lead the direction of the wipe and extends, uninterrupted, along the length (l) to prevent creating a "wake" of fluid on the printhead as it scrapes fluid and debris.

The length (l) also defines two opposed terminal sections TS1, TS2 of the blade 57 and an intervening central section CS. Each of the terminal sections TS is more rigid than the central section CS and connects to the foundational body 59 with a thicker expanse of flexible material 171. Whereas, the central section CS connects to the body with a thinner expanse of flexible material 173. In this way, the ends of the wiper are rigid and stiff, able to impart high wiping forces, while the middle of the wiper is less rigid and flimsier, able to impart lower wiping forces. In turn, the terminal sections TS serve to wipe printhead encapsulation while the central section CS serves to wipe the nozzle plate.

In more detail, the thinner expanse of flexible material illustrates a first curved surface 191 having a relative small curvature of radius "r1," whereas the thicker expanses of flexible material illustrate second curved surfaces 193 having larger curvatures of radius "r2" (r2>r1). The pivot points for the blade 57 are now made closer to the base 59 in the central section of the wiper (FIG. 4A), than is the pivot point for the blade 57 in either of the terminal sections of the wiper (FIG. 4B). In turn, the effective beam length ("e.b.l.") for the central section (e.b.l.1) is longer than the effective beam length (e.b.l.2) for the terminal sections, or e.b.l.1>e.b.l.2. The effect of this is a wiper with a flimsier central section having a wiping force lower than either of the terminal sections, being stiffer, having higher wiping forces. In one embodiment, the wiper defines radiuses for the terminal sections (r2) at about 2 mm, while also defining the radius at the central section (r1) at about 0.5 mm. In other embodiments, the radiuses change as designers see fit. Designers can also maintain constant a ratio between the terminal section and central section. By dividing the large radius number by the lower radius number, the ratio can be manipulated within a beneficial range, such as between ratios of 2-6, 3-5, or other.

Figure 5:
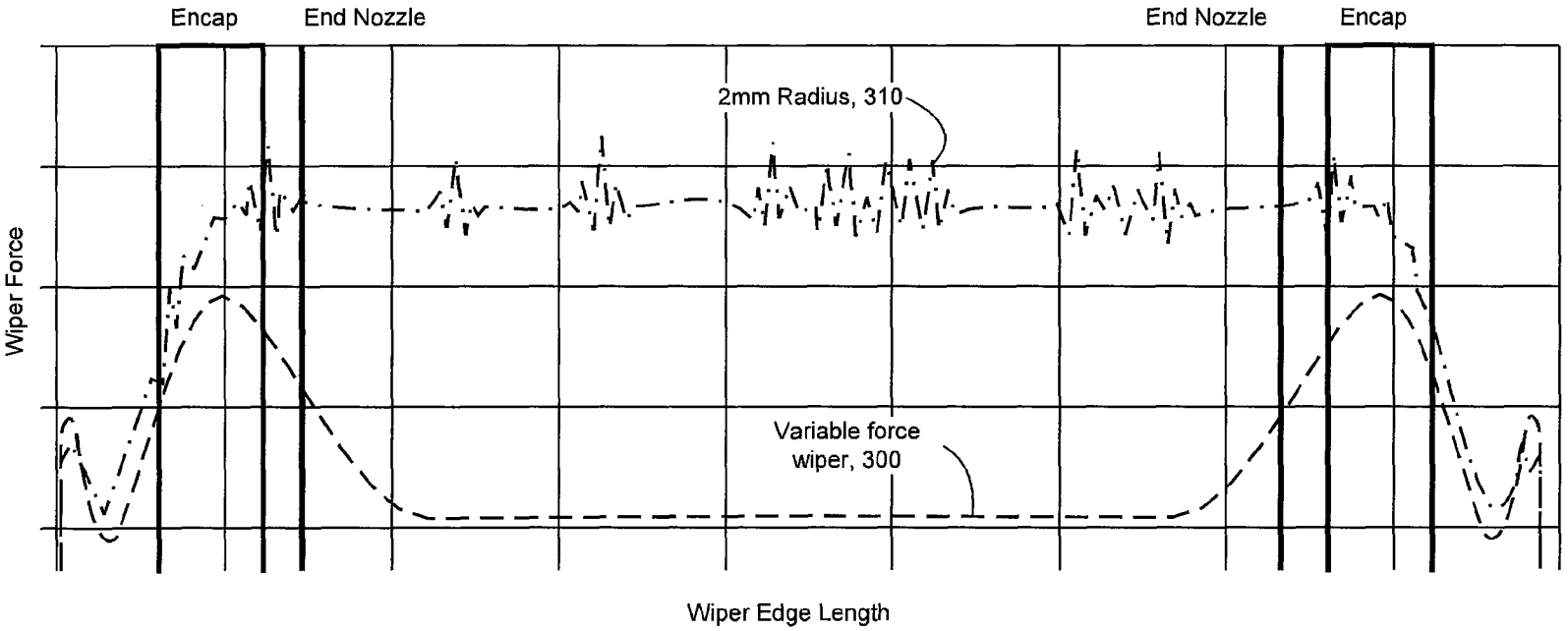
FIG. 5 is a graph showing modeling results for wiping the printhead of FIGS. 2A and 2B with the wiper of FIG. 3.

With reference to FIG. 5, finite element analysis of the variable force wiper having multiple sections of differing radiuses, curve 300, shows better results in comparison to a wiper having a common radius (2 mm), curve 310. As is seen, curve 300 has a relatively higher wiping force for a wiper scraping fluid and debris from the encapsulation ("encap") section of the printhead and a relatively lower force for the nozzle plate between the "end nozzles." The common radius wiper, in contrast, has the same wiping force throughout both the encap and nozzle plate sections of the printhead and is relatively high throughout (curve 310). While the high wiping force illustrated in curve 310 indeed wipes fluid and debris from the nozzle plate, high forces acting on the nozzle plate causes degradation of the nozzle plate over time. It has been suggested that hydrophobic qualities of the plate wear down thereby complicating behavior of the fluid on the nozzles. Also, common radius wipers with relatively low forces applied during wiping have been observed by the inventors to have difficulty cleaning in the nooks and crannies 130 noted in FIG. 2B.

Figure 7A:
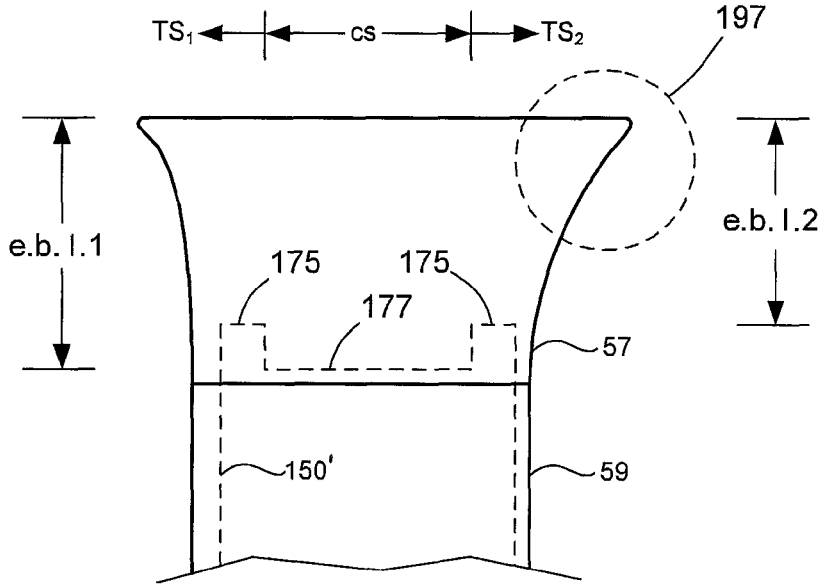
FIGS. 7A, 7B and 7C are alternate wiper embodiments.
Figure 7B:
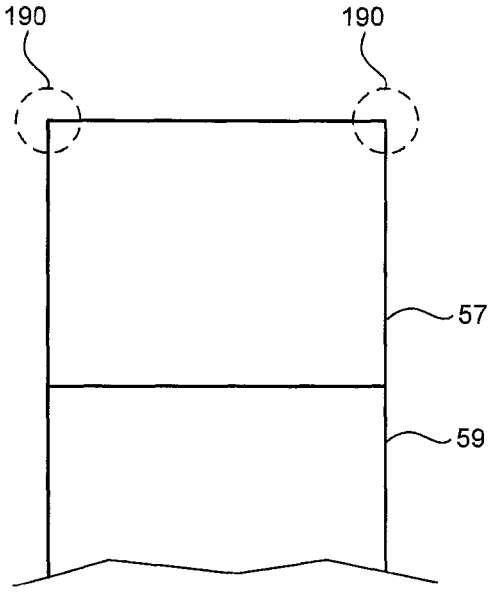
Figure 7C:
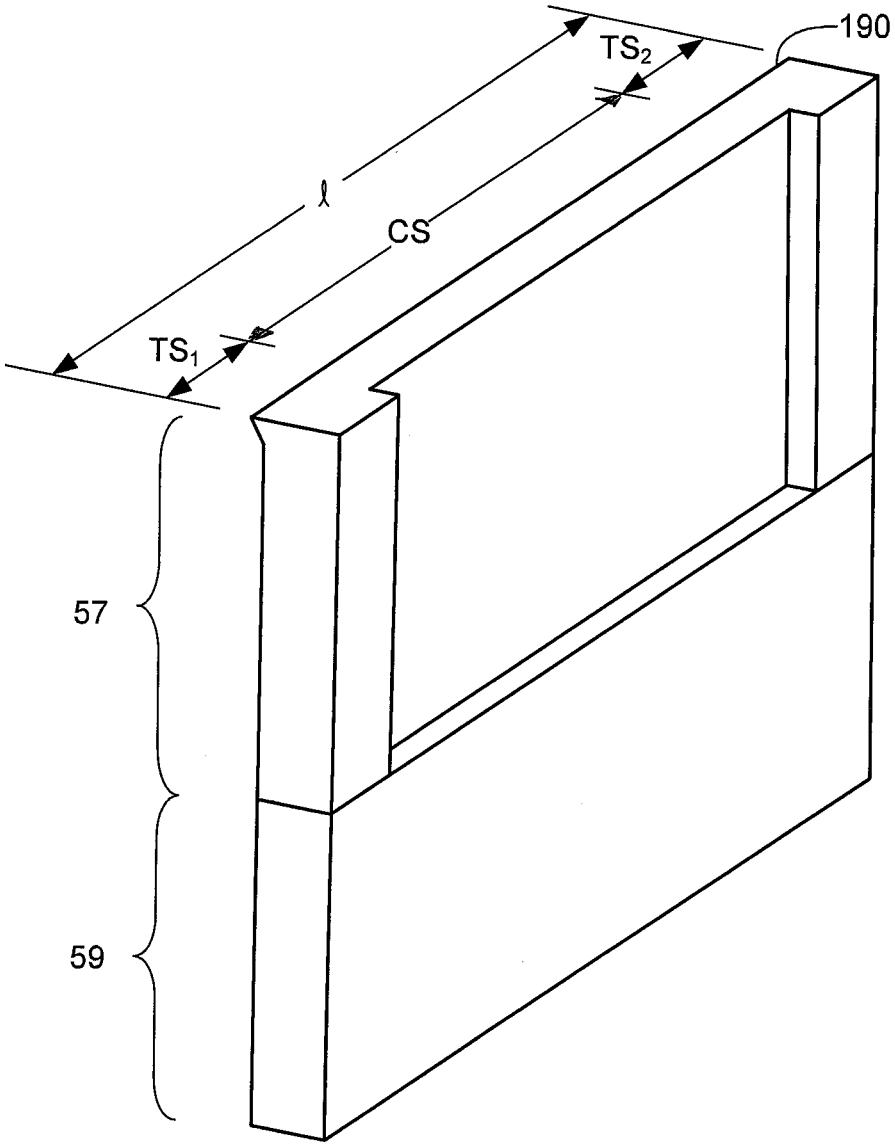

With reference to FIGS. 7A-7C, a variety of alternate embodiments are given. In FIG. 7A, the open slot 150' that mates with the similarly shaped/sized rigid member of the maintenance station is no longer simply rectangular. Instead, it has elevated portions 175 corresponding to the terminal sections TS of the wiper. Meanwhile, the open slot has a lower portion 177 corresponding to the central section CS of the wiper. Upon receipt of the rigid member, the terminal sections TS of the wiper are made more rigid than their counterpart center section CS. In turn, the effective beam length of the terminal section (e.b.l.2) is shorter than the effective beam length of the center section (e.b.l.1), or e.b.l.2<e.b.l.1.

In FIG. 7B, the terminal sections of the blade 57 have generally squared-off corners 190 instead of flared corners, e.g., 197, FIG. 7A. The squared-off corners are generally in line with the foundational body 59 of the wiper, whereas the flared corners extend outwardly from the foundational body and achieve a greater length for wiping.

In FIG. 7C, the thicker expanses of material of the terminal sections TS and the thinner expanse of material of the central section CS extend the entire height or majority height of the blade 57. In turn, there are no longer curved surfaces or curvatures of radiuses where the terminal and center sections TS, CS connect to the base 59. The rigidity of the terminal sections, however, still remains stronger than the rigidity of the center section and variability in wiping force is still achieved throughout the length of the wiper.

In any embodiment, the material of the wiper typifies an elastomer that can be repeatedly flexed over its lifetime. A particular useful elastomer is thermoplastic polyurethane, such as Pellethane sold by Lubrizol, Inc. It forms the blade of the wiper, but may also form the body.

Relatively apparent advantages of the many embodiments include, but are not limited to: (1) effectively wiping disparate printhead surfaces having disassociated sensitivities to wiping; (2) keeping contact between the wiper and wiping surfaces having dissimilar geographies; and (3) preventing wakes of wiped fluid on the printhead.

The foregoing illustrates various aspects of the invention. It is not intended to be exhaustive. Rather, it is chosen to provide the best illustration of the principles of the invention and its practical application to enable one of ordinary skill in the art to utilize the invention, including its various modifications that naturally follow. All modifications and variations are contemplated within the scope of the invention as determined by the appended claims. Relatively apparent modifications include combining one or more features of various embodiments with features of other embodiments.

The invention claimed is:

1. A wiper for a maintenance station of an imaging device, comprising:

a foundational body of the wiper that includes an open slot configured for receipt of a rigid member of the maintenance station to keep the foundational body of the wiper rigid during use; and a flexible blade disposed on the foundational body of the wiper and configured for scraping fluid and debris from a printhead of the imaging device upon deflection, the flexible blade being formed of a flexible material having two terminal sections and a central section defining a longitudinal extent of the blade, wherein each of the two terminal sections connects to the foundational body with a shorter effective beam length for wiping an encapsulant of the printhead while the central section of the blade connects to the foundational body with a longer effective beam length for wiping a nozzle plate of the printhead so that the flexible blade imparts a different wiping force to each of the encapsulant and the nozzle plate of the printhead corresponding to a different durability of each of the encapsulant and the nozzle plate of the printhead.

2. The wiper of claim 1, wherein said each of the two terminal sections connects to the foundational body with a thicker expanse of said flexible material whereas the central section connects to the body with a thinner expanse of said flexible material.

3. The wiper of claim 2, wherein said each of the two terminal sections connects to the foundational body with a same exact thickness of said thicker expanse.

4. The wiper of claim 1, wherein the shorter effective beam length provides a higher wiping force to said each of the two terminal sections of the flexible blade and the longer effective beam length provides a lower wiping force to said central section of the flexible blade.

5. The wiper of claim 1, wherein the open slot defines a substantially rectangular opening.

6. The wiper of claim 1, wherein the flexible material is a thermoplastic elastomer.

* * * * *